United States Patent [19]

Shepard

[11] Patent Number: 4,461,408

[45] Date of Patent: Jul. 24, 1984

[54] DISPENSER

[76] Inventor: John S. Shepard, 1304 S. Shields, Ft. Collins, Colo. 80522

[21] Appl. No.: 386,250

[22] Filed: Jun. 8, 1982

[51] Int. Cl.[3] ..... B65D 5/72

[52] U.S. Cl. ..... 222/501; 222/518; 401/148

[58] Field of Search ..... 222/501, 518, 511, 559, 222/563, 544, 575, 491, 494, 496, 495; 401/147, 148, 264, 260, 273, 206

[56] References Cited

U.S. PATENT DOCUMENTS

| | | | |
|---|---|---|---|
| 2,714,475 | 8/1955 | Roehrich | 222/501 |
| 2,779,518 | 1/1957 | Morris | 222/501 |
| 2,968,826 | 1/1961 | Leshin | 15/132.7 |
| 2,984,393 | 5/1961 | Magnenat | 222/501 |
| 3,169,267 | 2/1965 | Luedtke | 15/566 |
| 3,241,727 | 3/1966 | Heckman | 222/213 |
| 3,523,628 | 8/1970 | Calvin et al. | 222/107 |
| 3,658,216 | 4/1972 | Schwartzman | 222/518 |

FOREIGN PATENT DOCUMENTS

| | | | |
|---|---|---|---|
| 962223 | 6/1950 | France | 222/501 |

*Primary Examiner*—Joseph J. Rolla
*Assistant Examiner*—Kenneth Noland
*Attorney, Agent, or Firm*—Hugh H. Drake

[57] ABSTRACT

A dispenser is intended to be used with a container of glue that enables pressurized outflow of the glue from an upstanding neck that is threaded to receive the dispenser. A cap threads upon the neck and has an annular top wall. A hollow snout of resilient material projects upward from the top wall and terminates in an opening that defines a valve seat. A guideway in the snout slidably accepts a rod on the upper end of which is a valve. Encircling the lower end portion of the rod is a ring so sized as to be seatable against the top wall of the cap. A plurality of resilient webs are circumferentially distributed in a normal plane and integrally extend between the ring and the rod with each of those webs generally defining a partial spiral and the webs together enabling longitudinal movement of the rod when the ring is seated against the top wall of the cap.

4 Claims, 5 Drawing Figures

DISPENSER

This invention relates to a dispenser. More particularly, it pertains to a dispensing cap attachable to a container of glue.

Many members of the public are acquainted with a product identified as "Elmer's" glue. It typically is provided in a squeeze bottle on top of which is a dispensing cap. The contained glue has been found to be useful in the home, the office and in the schools.

The cap on the conventional Elmer's glue container includes a plunger-valve that is pulled out to enable dispensing or is pushed in in an effort to seal the dispensing passageway. In usage, it has been found that increments of the glue tend to build up as between various joining surfaces in a manner which may either make it difficult for the user to open the valve mechanism and obtain a desired output flow of the glue or interfere with proper closure of the valve mechanism after use so as to ensure sealing of the container. A rather unique difficulty has been encountered by teachers of children in the schools with respect to arts and crafts. One problem has been that some children will walk around the room holding the container upside down with the valve open. Of course, a related difficulty was that the children sometimes could not be depended upon to reclose the valve mechanism after use. Naturally, it has been the teacher in such circumstances who has ended up having to clean the dispensing caps and even has had to clean the mess off the floor.

Such problems were addressed in U.S. Pat. No. 4,281,779—Shepard. Different features as therein disclosed overcome the deficiencies and resolve the problems mentioned above. In that patent, a spring-loaded ball is encapsulated within the dispensing cap and cooperates therewith to establish an outlet valving action that guards against unwanted dribble as well as against an undue buildup of glue that may harden and later cause difficulty. Nevertheless, the embodiments disclosed in that patent have encountered their own difficulties.

The relevant specific embodiments of the aforementioned patent involve the use of four different parts that must be mated together in combination. Because the parts are of different materials and shapes, an expensive degree of assembly at the manufacturing level is encountered. When a user seeks to transfer such a dispensing cap from one unit to another, there also is a likelihood that the user may lose or otherwise misplace either the small ball or the spring involved in that approach.

It is, accordingly, a general object of the present invention to provide a new and improved dispenser that overcomes the deficiencies and problems encountered not only with the conventional dispenser first discussed but also with respect to the improved dispenser of the aforementioned patent.

The prior art with respect to this general kind of dispensing cap has sought to rid itself of the use of a separate spring for enabling valve closure. Exemplary references in that regard are U.S. Pat. Nos. 2,968,826—Leshin, 3,169,267—Luedtke, 3,523,628—Colvin et al, 3,241,727—Heckman, and 2,984,393—Magnenat. Both Leshin and Colvin are deficient, for reasons already discussed, in that they use a separate ball. In addition, Leshin has a resilient spider of a kind that does not allow enough deflection of its ball to accommodate other than a mere oozing of a contained liquid, as is intended with its particular product application. On the other hand, Colvin et al also is deficient in requiring the use of an elongated resilient helix that undesirably increases the length of the cap assembly.

Like Leshin, Luedtke is useful only with regard to a comparatively large ball-type applicator of the kind which allows the liquid to be distributed about the broad surface of that kind of device; its cap also requires use of a too-long kind of helix as a resilient element.

Heckman and Magnenat admirably dispense with the need for a separate ball. However, Heckman's approach relies on a combination with the container itself to operate a valving structure.

Magnenat is deficient in relying upon an elongated helix-type structure that requires the assembly of at least four separate parts, requires additional length in its structure to accommodate the use of a helix as well as to achieve the degree of sealing necessary and doesn't even apply to a dispensing cap that will handle all of the problems when merely attached to a conventional container.

It is, therefore, another general object of the present invention to provide a new and useful dispenser which also overcomes the problems and deficiencies presented by such additional prior art.

A further object of the present invention is to provide a new and improved dispensing cap which is composed of no more than two parts and yet which is capable of accomplishing what presumably were objectives of the prior art which involved the use of additional numbers of parts.

Still another object of the present invention is to provide a new and improved dispensing arrangement that is capable of being manufactured in a most-economical manner and yet which is fully effective for the purpose intended.

A still further object of the present invention is to provide a new and improved dispensing cap that, in the environment involved, works better than anything heretofore suggested.

In accordance with the present invention, a dispenser is accommodated for use with a container of glue that enables the pressurized outflow of the glue from the container, and that container has an upstanding neck threaded to receive the dispenser. A cap for the neck includes a cylindrical sidewall formed to define threads matable to the threads on the neck. Projecting integrally inward from the upper perimeter of the sidewall is an annular top wall. A generally conical snout of resilient material projects integrally upward from the inner periphery of the annular wall and terminates in a margin that defines an upwardly-facing opening with the inward surface of that margin being shaped to define a valve seat. Projecting integrally inward from that snout is a guideway slidably within which is an elongated rod, the upper end portion of the rod being shaped to define a valve that sealingly engages the seat. A ring encircles the lower end portion of the rod and has an external diameter enabling sliding reception of the ring within the cap sidewall as well as having an internal diameter essentially no less than the diameter of the inner periphery of the annular wall, so that the ring is seatable against the wall. A plurality of resilient webs are circumferentially distributed in a normal plane and integrally extend between the ring and the rod. Each of the webs generally defines a partial spiral and the webs together enable longitudinal movement of the rod toward and away from the opening when the ring is seated against the top wall.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements and in which:

Figure 1:
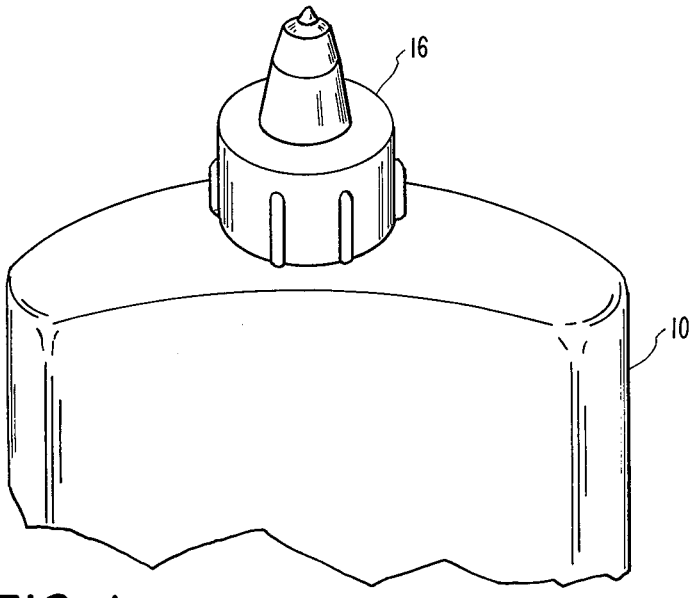
FIG. 1 is a framentary isometric view of a cap and container assembly.

A container 10 is formed of flexible walls that may be squeezed to enable the pressurized outflow of glue therefrom. Extending outwardly from the container is an upstanding neck 12 threaded at 14 to receive a dispenser.

A cap 16 for neck 12 includes a cylindrical sidewall 18 formed to define threads 20 matable with threads 14 on neck 10. An annular top wall 22 projects integrally inward from the upper perimeter of sidewall 18.

As used herein, such words as "top", "upper" and the like relate to the position when container 10 is sitting in a normal upright position on a flat surface so that cap 16 is on top. Naturally, a reversal of such terms might become appropriate when the entire assembly is inverted for use.

A generally-conical hollow snout 24 is composed of a resilient material and projects integrally upward from the inner periphery 26 of annular wall 22 and terminates in a margin 28 that defines an upwardly-facing opening 30. The inner surface 32 of margin 28 defines a valve seat as a result of being shaped in the form of a circumferential rib 34. Projecting integrally inward from the interior wall of snout 24 are a circumferentially-spaced plurality of flanges 36 directed radially inward so as to define a guideway 38.

Slidably received within guideway 38 is an elongated rod 40, its upper end portion 42 being conically-tapered to define a valve sealingly engagable with seat 32. Encircling the lower end portion of rod 40 is a ring 44 that has an external diameter which enables sliding reception of ring 44 within threads 20 on sidewall 18. Ring 44 also has an internal diameter essentially no less than the diameter of internal periphery 26 of annular wall 22, so that ring 44 is seatable against wall 22. Preferably, the outer periphery of ring 22 is sized to be received frictionally within sidewall 18, so that, once the parts are assembled, ring 44 normally is captivated within sidewall 18.

A plurality of resilient webs, in this case three for preferred performance, are circumferentially distributed in a normal plane and integrally extend between ring 44 and rod 40. Each of webs 50 generally defines a partial spiral. Webs 50 together enable longitudinal movement of rod 40 toward and away from opening 30 when ring 44 is seated against top wall 22. Each of webs 50 is J-shaped. The end 52 of the shorter leg is integrally joined to rod 40, and the end 54 of the longer leg is integrally joined to ring 44.

Figure 2:
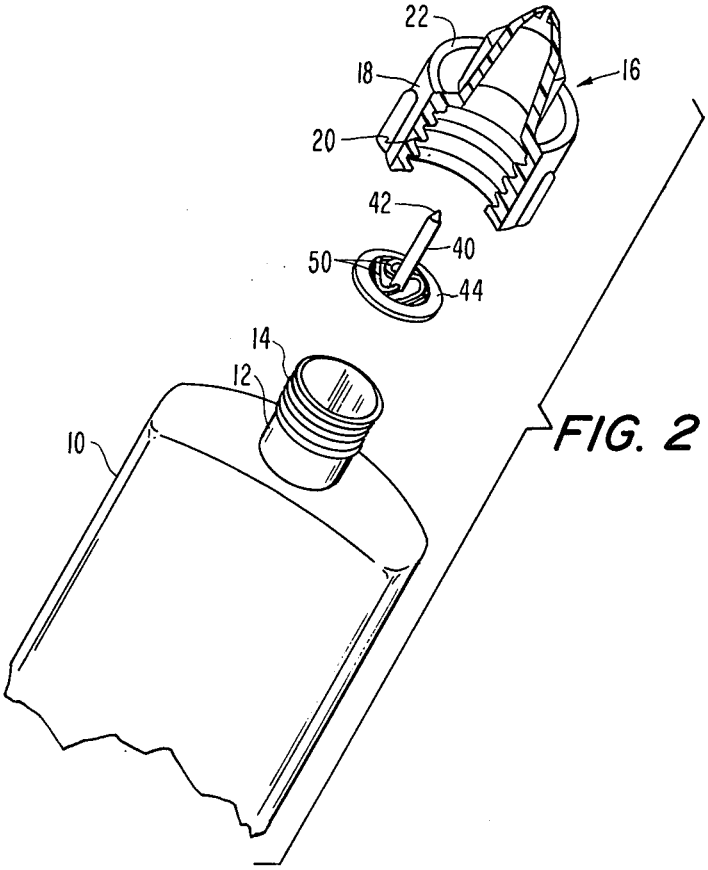
FIG. 2 is an isometric exploded view, partially broken away, of the assembly of FIG. 1.
Figure 3:
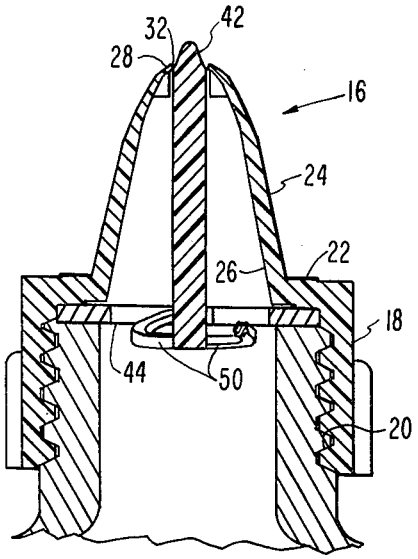
FIG. 3 is a fragmentary cross-sectional view of the cap mounted on the neck of the container.
Figure 4:
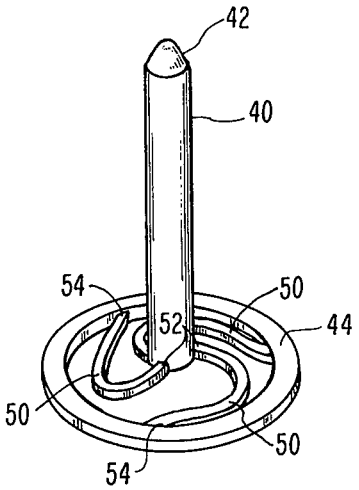
FIG. 4 is an enlarged isometric view of a component shown in FIG. 2.
Figure 5:
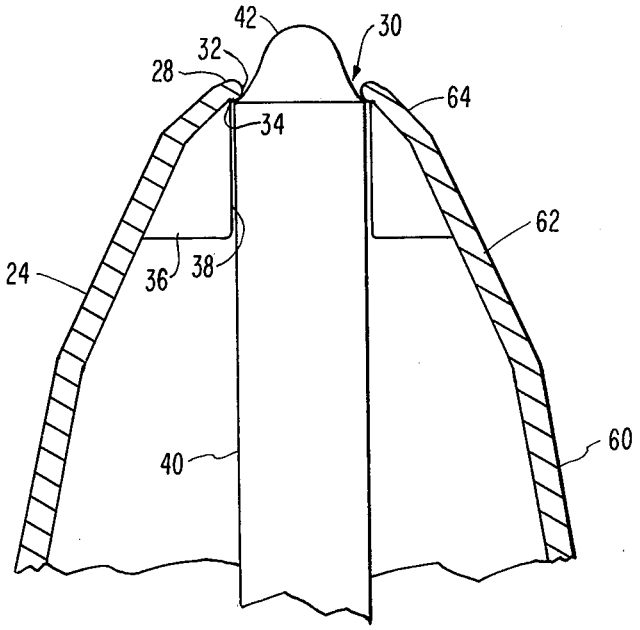
FIG. 5 is an enlarged cross-sectional view of a portion of FIG. 3.

When ring 44 is detached from cap 16, as shown in FIG. 2, webs 50 lie in a plane normal to rod 40. When the combination of rod 40 and ring 44, however, are assembled onto the container as shown in FIG. 3, resilient webs 50 are bowed downwardly. That bowing exerts a positive upward force on rod 40 that urges valve 42 against valve seat 32.

Preferably, snout 24 first tapers laterally inward away from wall 22 at a given angle, as at 60, thereafter includes an intermediate portion 62 that tapers laterally inward at a significantly sharper angle and then further includes at least one more additional portion 64 that tapers laterally inward at a still-sharper angle into termination with opening 30.

In use, it is only necessary to touch the outer end 42 of rod 40 against a surface to enable the dispensing of glue. When that "touch" is not maintained, however, the dispenser is returned to a closed condition, so that the glue will not drip downwardly regardless of the orientation of the overall assembly that includes the container. At the same time, the seal established between valve 42 and seat 32 create a closure that prohibits air from entering into the interior of cap 16 and thereby tending to dry the glue. Any residue of glue left on the exterior of cap 16 can easily be wiped away. Even should residue be allowed to remain and harden as between the upward end of rod 40 and opening 30, the flexibility provided by the use of resilient materials and the multiply-tapered shape of snout 24 enables the inducement of opposing forces, upon mere tapping of the apex of rod 40 against a suface, to break any solid seal that has been formed.

Economy is present because only two pieces are needed to form the entire cap assembly. Yet, all the problems initially mentioned have been overcome.

Ring 44 serves not only to anchor the outer ends of webs 50 in a fixed position but also serves as a sealing gasket as between cap 16 and neck 12. The purpose of that gasket is to deny entry of air through the threads and into the squeeze bottle. Because ring 44 is comparably thin and webs 50 lie in a generally flat plane and also are thin, there is no need to modify the structure of bottle 10 or its neck 12 in order to accommodate the placement of ring 44 and its integrally-connected rod 40. On the other hand, that "flattened" configuration of ring 44 together with webs 50 enables snout 24 to be shorter than would be the case if some kind of helical spring mechanism were employed.

For dispensing glue, the user need only invert and slightly squeeze the walls of bottle 10 while tapping the nose portion of snout 24 against the surface to which glue is to be applied, specifically tapping the outer point of rod 40. For most purposes, only the slight impact imposed with such tapping will be all that is needed to open the valve to permit dispensing. When the assembly is set aside, however, a portion of the glue may cling to the inside of the nose portion of the snout and onto the inward edge surfaces of flanges 36 and around the outer end of rod 40 and its valve. If that residue ultimately dries, mere tapping impact, at least within reason, may be insufficient to open the valve. It is for that reason that snout 64 is molded from a resilient material and that it includes successively-increasing tapers 60, 62 and 64. It has been found that the increased degree of flexibility imparted by the tapers significantly enhances the capability of being able to dislodge rod 40 from a "stuck" position caused by dried glue.

To achieve the necessary flexibility and resiliency for such purposes, caution should be excercised in the selection of the material from which both parts of the device are formed. Polypropylene, used for both of the two parts, has been found to be entirely satisfactory. On the other hand, polyethylene yielded insufficient reliability of performance, because it did not exhibit sufficient resiliency as required either in webs 50 or in the walls of snout 24.

It should be noted that the dispenser is not intended for use with all glues. It performs admirably with water-soluble glues such as the aforementioned Elmer's glue. On the other hand, it is not recommended for glues of the chemical-oxydition type; they tend to interact with and set up too firmly within snout 16 when formed of a preferred material such as polypropylene. Thus, for possible use to dispense materials other than the intended species of glue, the user would be well advised first to run tests to determine suitability.

It may also be noted that the dispenser is reusable many times on successive bottles of glue. The user need only detach and discard the originally supplied dispensing cap assembly and substitute this one in order to acheive superior performance and avoidance of the problems discussed in the introduction. Moreover, the kind of squeeze bottles usually supplied originally also can be reused. Thus, a large user of glue, such as an art or graphics department, is able, if desired, to purchase the glue itself in bulk form, thereby acheiving additional economy.

While a particular embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of that which is patentable.

I claim:

1. For use with a container of glue that enables pressurized outflow of said glue from the container, said container having an upstanding neck threaded to receive a dispenser, a dispenser comprising:

a cap for said neck that includes a cylindrical sidewall formed to define threads matable with the threads on said neck;

an annular top wall projecting integrally inward from the upper perimeter of said sidewall;

a generally-conical hollow snout projecting integrally upward from the inner periphery of said annular wall and terminating in a margin that defines an upwardly-facing opening, the inward surface of said margin being shaped to define a valve seat;

means projecting integrally inward from said seat to define a guideway;

an elongated rod slidable within said guideway, the upper end portion of said rod being shaped to define a valve sealingly engagable with said seat;

a ring encircling the lower end portion of said rod, having an external diameter enabling sliding reception of said ring within said sidewall and an internal diameter essentially no less than the diameter of said inner periphery, whereby said ring is seatable against said top wall;

and a plurality of resilient webs circumferentially distributed and spaced apart in a normal plane when unstressed and integrally extending between said ring and said rod, each of said webs generally defining a partial spiral, when the combination of the rod and ring is assembled onto the container, the resilient webs are then stressed into a bowed configuration, and that bowing exerts a force on the rod that urges the valve of the rod against the valve seat of the snout.

2. A dispenser as defined in claim 1 in which said inward surface is in the shape of a circumferential rib.

3. A dispenser as defined in claim 1 in which said snout is of a resilient material and in which said snout first tapers laterally inward away from said top wall at a given angle and thereafter includes at least one additional portion that tapers laterally inward at a significantly sharper angle, said tapers imparting increased flexibility to said snout for enhancing dislodgment of said rod when stuck in a fixed position by dried glue present on the interior of said snout.

4. For use with a container of glue that enables pressurized outflow of said glue from the container, said container having an upstanding neck threaded to receive a dispenser, a dispenser comprising:

a cap for said neck that includes a cylindrical sidewall formed to define threads matable with the threads on said neck;

an annular top wall projecting integrally inward from the upper perimeter of said sidewall;

a generally-conical hollow snout projecting integrally upward from the inner periphery of said annular wall and terminating in a margin that defines an upwardly-facing opening, the inward surface of said margin being shaped to define a valve seat;

means projecting integrally inward from said seat to define a guideway;

an elongated rod slidable within said guideway, the upper end portion of said rod being shaped to define a valve sealingly engagable with said seat;

a ring encircling the lower end portion of said rod, having an external diameter enabling sliding reception of said ring within said sidewall and an internal diameter essentially no less than the diameter of said inner periphery, whereby said ring is seatable against said top wall;

a plurality of resilient webs circumferentially distributed and spaced apart in a normal plane when unstressed and integrally extending between said ring and said rod, each of said webs generally defining a partial spiral and said webs together enabling longitudinal movement of said rod toward and away from said opening when said ring is seated against said top wall;

and each of said webs being generally J-shaped, the end of the shorter leg being integrally joined to said rod and the end of the longer leg being integrally joined to said ring.

* * * * *